US005605120A

United States Patent [19]

Hedelin

[11] Patent Number: 5,605,120

[45] Date of Patent: Feb. 25, 1997

[54] METHOD AND A DEVICE FOR CHANGING THE COMPRESSION RATIO IN AN INTERNAL COMBUSTION ENGINE

[75] Inventor: Lars Hedelin, Djursholm, Sweden

[73] Assignee: Fanja Ltd., St. Helier, United Kingdom

[21] Appl. No.: 362,444

[22] PCT Filed: Jun. 30, 1993

[86] PCT No.: PCT/SE93/00597

§ 371 Date: Feb. 9, 1995

§ 102(e) Date: Feb. 9, 1995

[87] PCT Pub. No.: WO94/00681

PCT Pub. Date: Jan. 6, 1994

[30] Foreign Application Priority Data

Jun. 30, 1992 [SE] Sweden ..... 9202018

[51] Int. Cl.[6] ..... F02B 75/04; F02B 75/36

[52] U.S. Cl. ..... 123/78 C; 123/48 C

[58] Field of Search ..... 123/78 C, 78 F, 123/48 B, 48 C

[56] References Cited

U.S. PATENT DOCUMENTS

| | | | |
|---|---|---|---|
| 1,872,856 | 8/1932 | Walker | 123/78 F |
| 2,670,724 | 3/1954 | Reggio | 123/78 F |
| 3,633,552 | 1/1972 | Huber | 123/78 F |
| 4,174,683 | 11/1979 | Vivian | 123/78 C |
| 4,301,695 | 11/1981 | Reiher | 123/78 F |
| 4,738,230 | 4/1988 | Johnson | 123/78 F |
| 4,860,702 | 8/1989 | Doundoulakis | 123/78 F |
| 4,873,947 | 10/1989 | Ryan, III et al. | 123/78 C |
| 5,165,368 | 11/1992 | Schechter | 123/78 F |
| 5,215,051 | 6/1993 | Smith | 123/78 F |
| 5,329,893 | 7/1994 | Drangel et al. | 123/78 C |

FOREIGN PATENT DOCUMENTS

| | | |
|---|---|---|
| 813503 | 6/1937 | France . |
| 3004402 | 8/1981 | Germany . |
| 3127760 | 3/1983 | Germany . |
| 3644721 | 7/1988 | Germany . |

*Primary Examiner*—David A. Okonsky
*Attorney, Agent, or Firm*—Young & Thompson

[57] ABSTRACT

A process and apparatus for setting the compression ratio of an internal combustion engine by changing the relative distance between the axis of rotation of the engine crankshaft and the engine cylinder head surface delimiting the end of each cylinder in the engine. Relative displacement between the rotational axis of the crankshaft and the cylinder head is effected along a predetermined path that has components both parallel and transverse to the longitudinal axis of each of the engine cylinders. The crankshaft is held with its rotational axis stationary in relation to the engine mountings and the vehicle in which the engine is mounted, and the cylinder head is displaced along the predetermined path together with the cylinder.

9 Claims, 5 Drawing Sheets

METHOD AND A DEVICE FOR CHANGING THE COMPRESSION RATIO IN AN INTERNAL COMBUSTION ENGINE

The invention relates to a process for setting the compression ratio in an internal combustion engine by changing the relative distance between the axis of rotation of the engine crankshaft and the engine cylinder head surface delimiting the end of each cylinder in the engine, and a device for carrying out said process.

Conventional internal combustion engines work with a fixed compression ratio which is determined by the dimensions of the engine components. In order to change the compression ratio, the engine must be disassembled and components with other dimensions must be built into the engine, for example pistons of another height or a cylinder head with another design of the combustion chamber. This means that the compression ratio cannot be changed simply.

In certain cases, there is a need to change the engine compression ratio to adapt it to fuels of varying qualities, and different proposals have been made to achieve this. All of these, however, only provide the possibility of a relatively small change in the compression ratio.

The purpose of the present invention is to provide a device which makes possible a great change in the compression ratio in an internal combustion engine, so that the compression ratio can, for example, be changed within the range 4–40, during operation. This means that the compression ratio can be changed depending on the current engine operating conditions, so that the engine efficiency can be improved, especially under partial load, so that the engine power range can be increased. In order to fully exploit these possibilities, the supply of air and fuel to the engine should also be controlled in relation to the set compression ratio. For this, suitable valve systems are required and systems for supplying air and fuel, but these systems do not constitute any part of the present invention and therefore will not be described in more detail here.

According to the invention, rotation of the adjustment discs displaces the rotational axis of the crankshaft in two dimensions, namely, on one hand, parallel to the longitudinal axis of each engine cylinder, and, on the other hand, perpendicular thereto. In this manner, there is provided, in addition to a change in the compression ratio, also a lateral displacement of the crankshaft, which means that the angular relationship for the crankshaft in each cylinder is changed.

Figure 3:
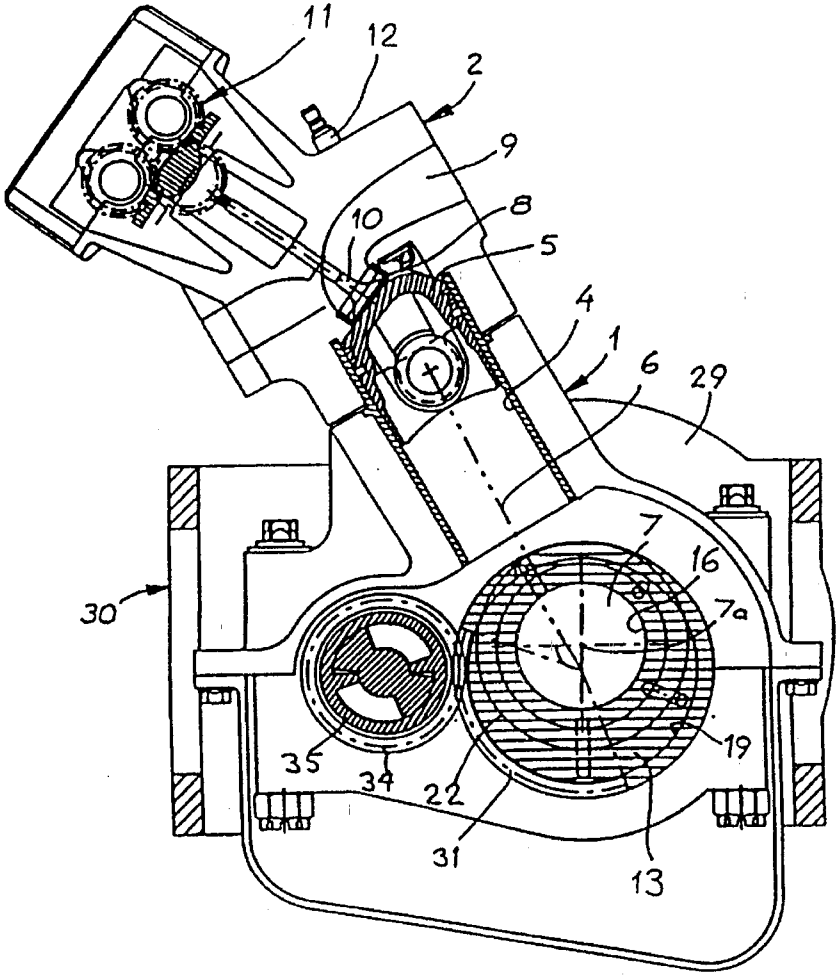
Figure 2:
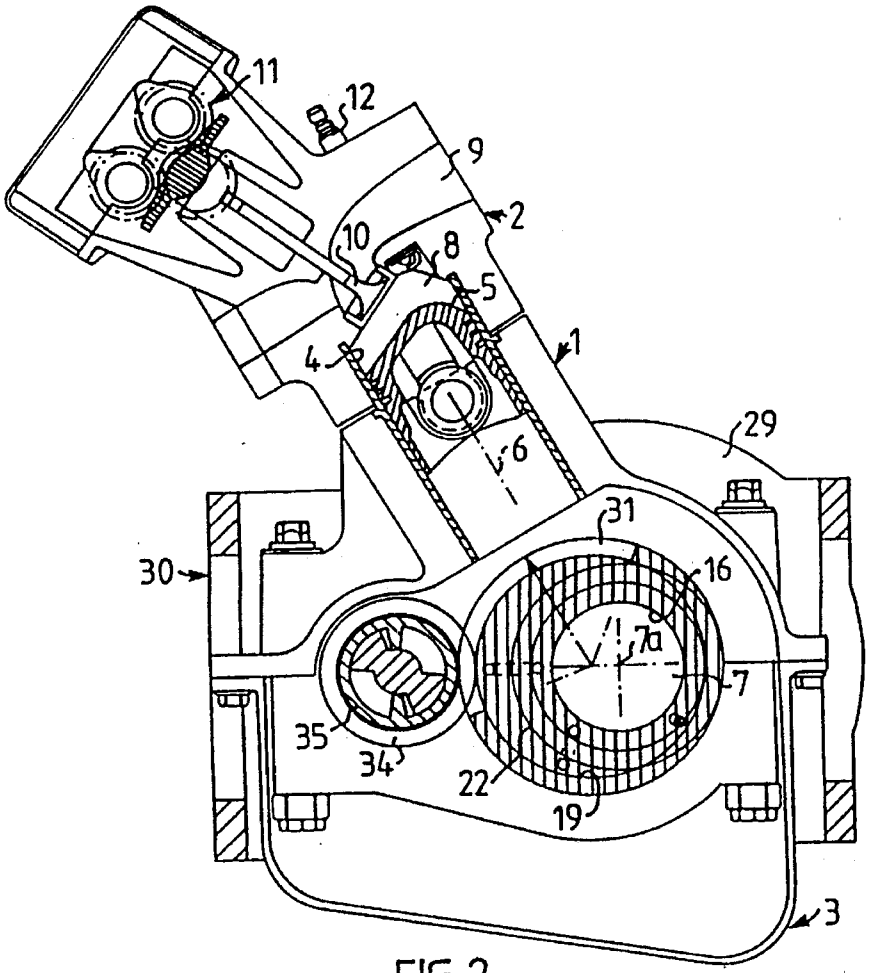
Figure 3:
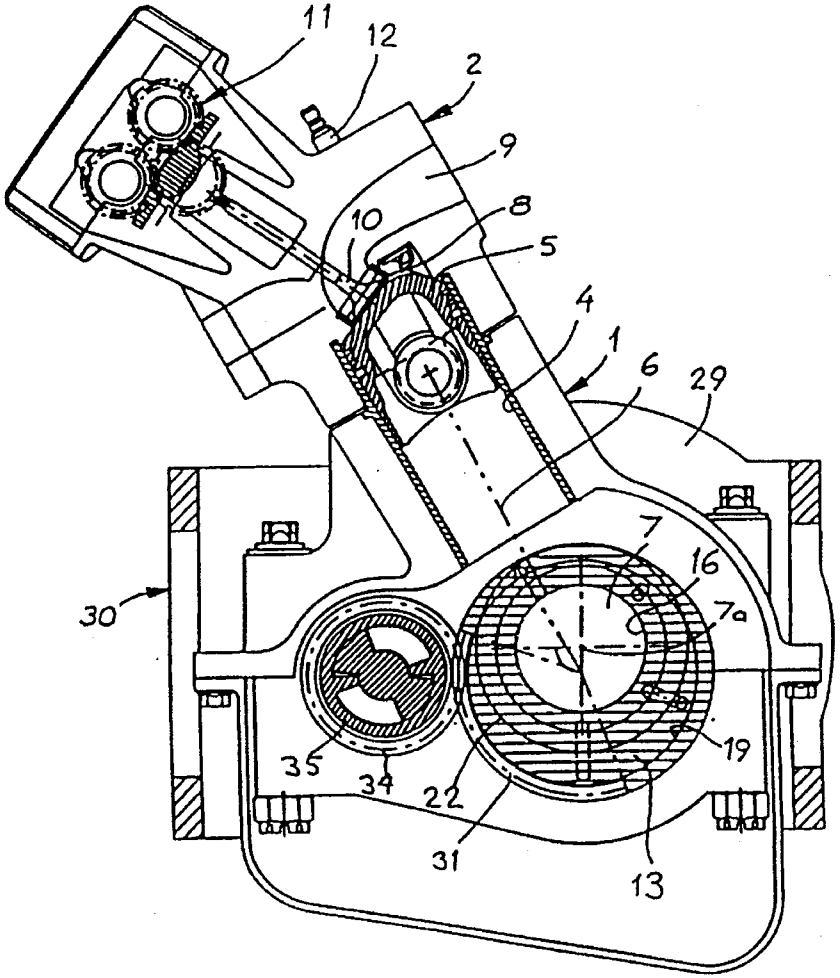
Figure 2:
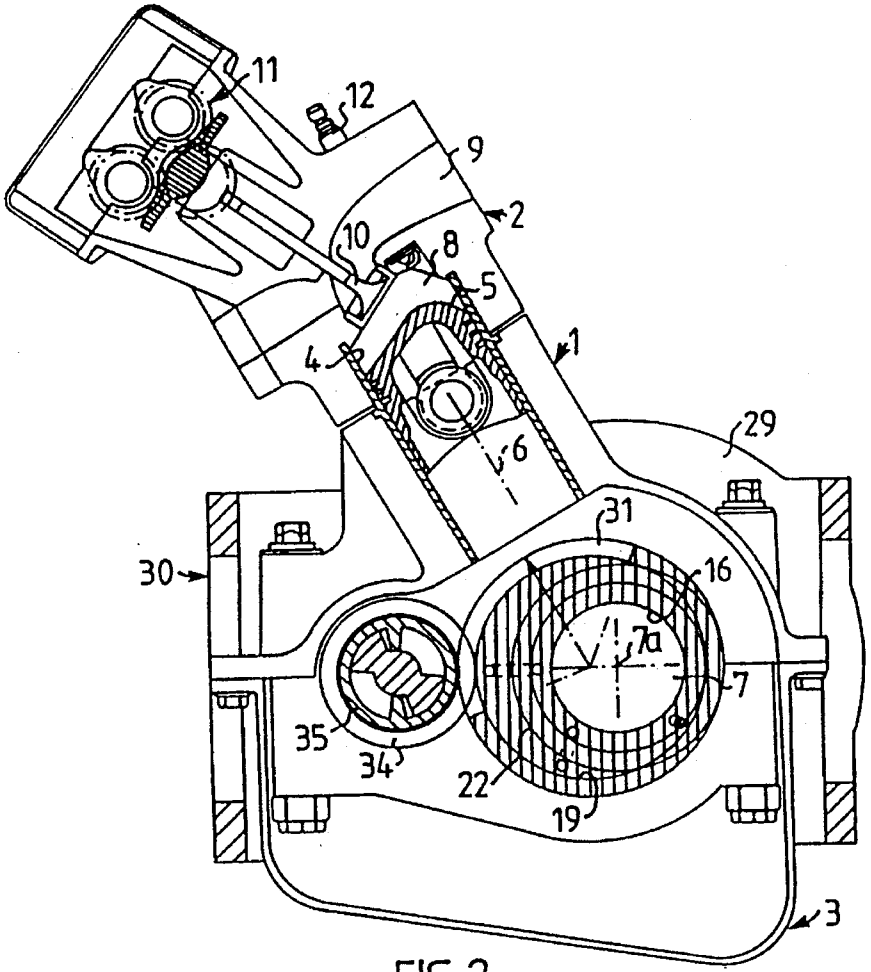
Figure 5:
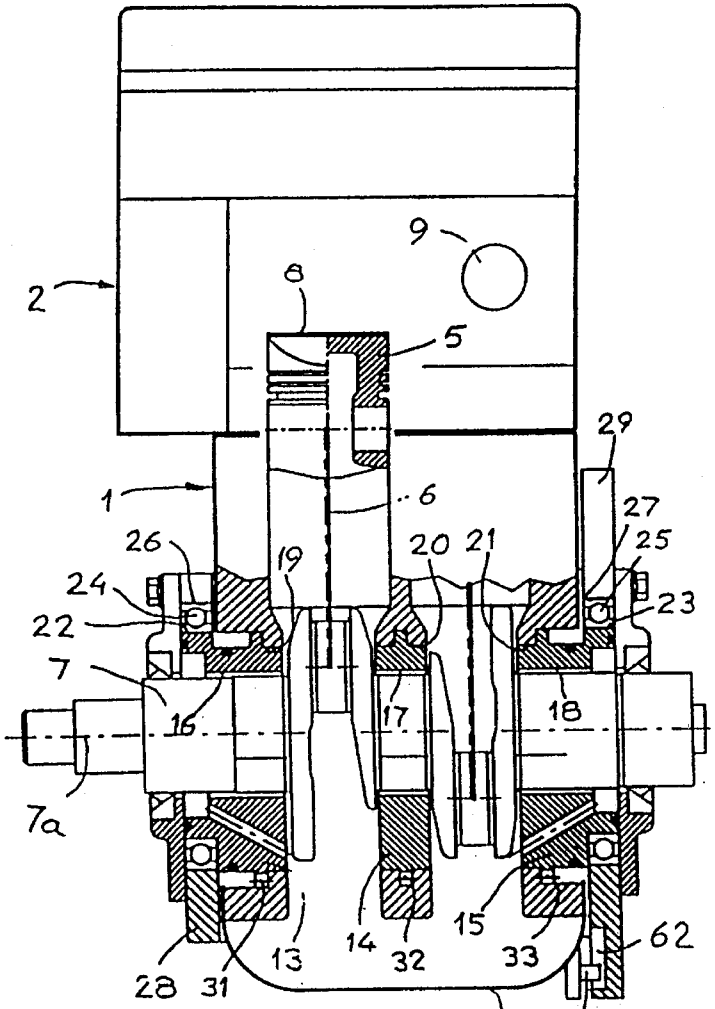
Figure 4:
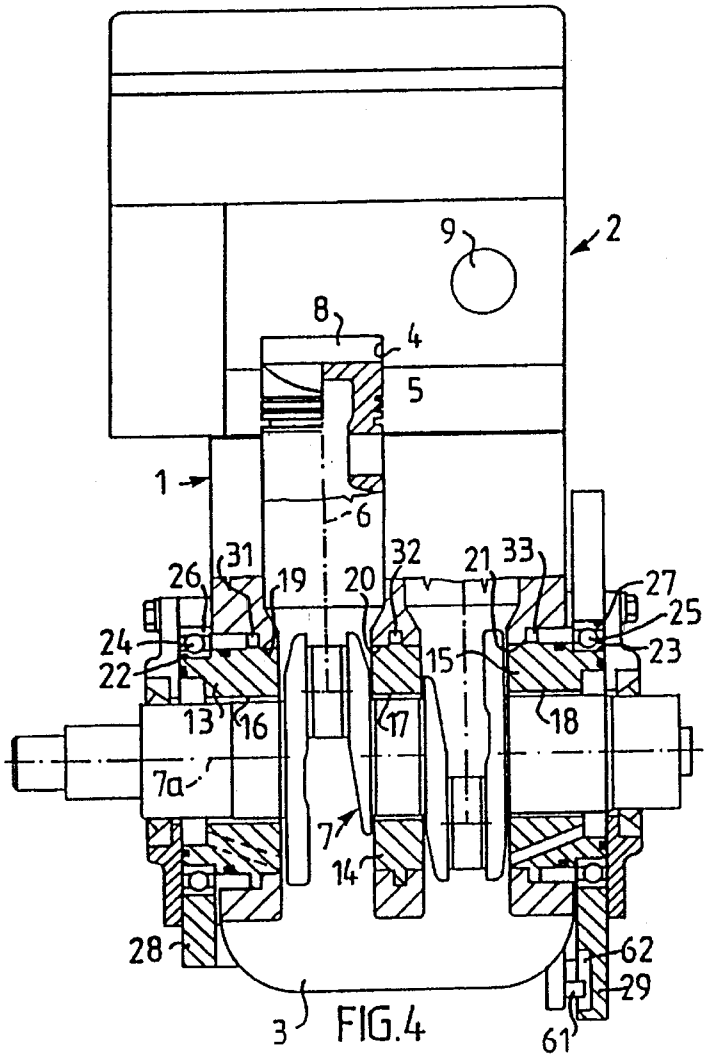
Figure 9:
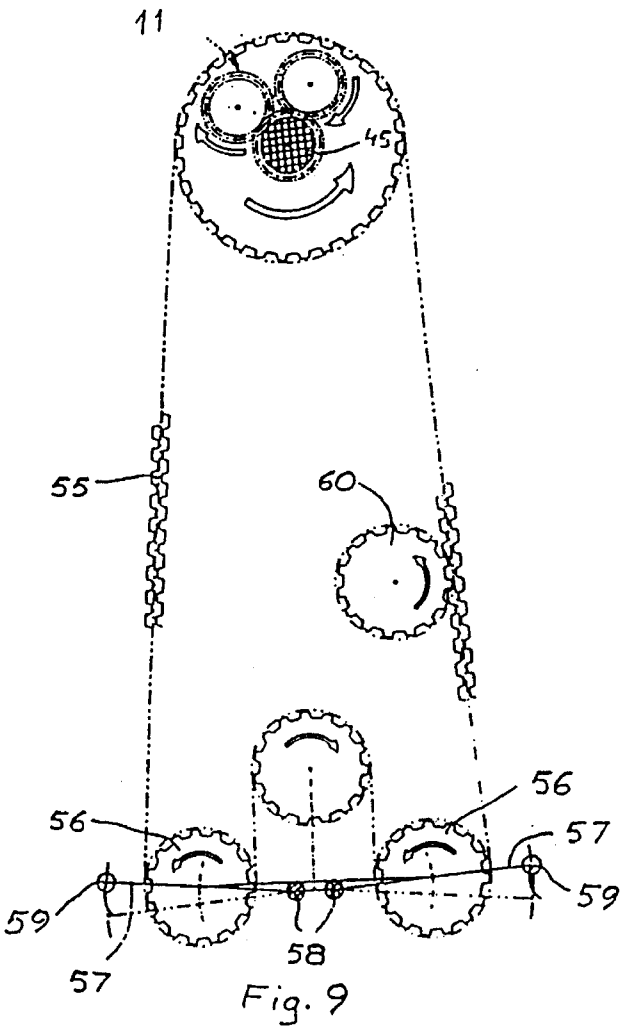
Figure 6:
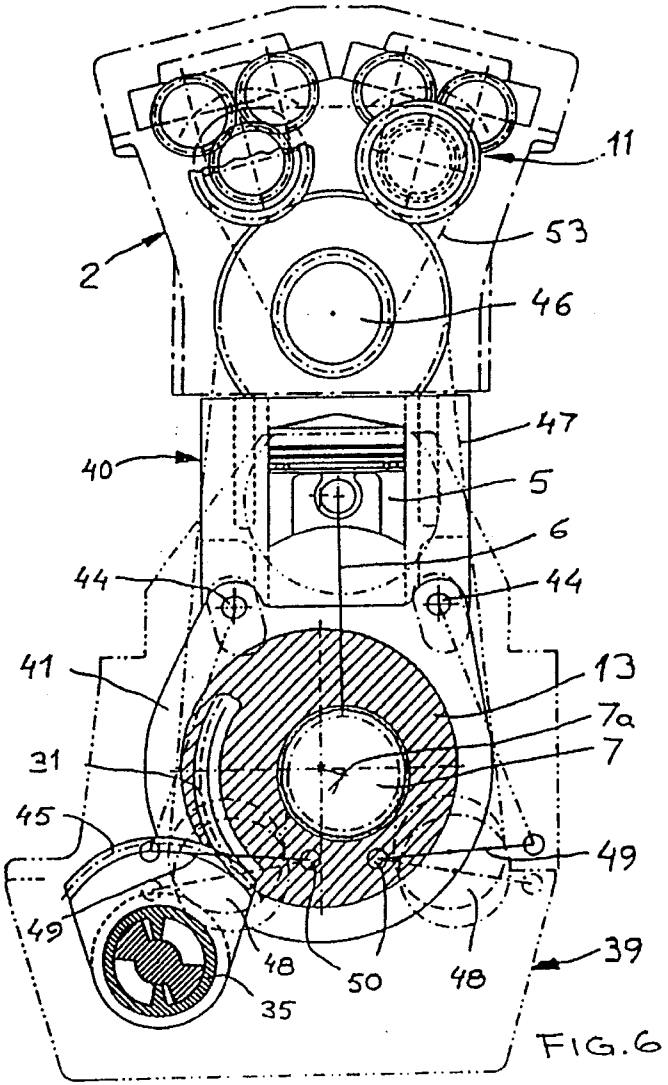
Figure 8:
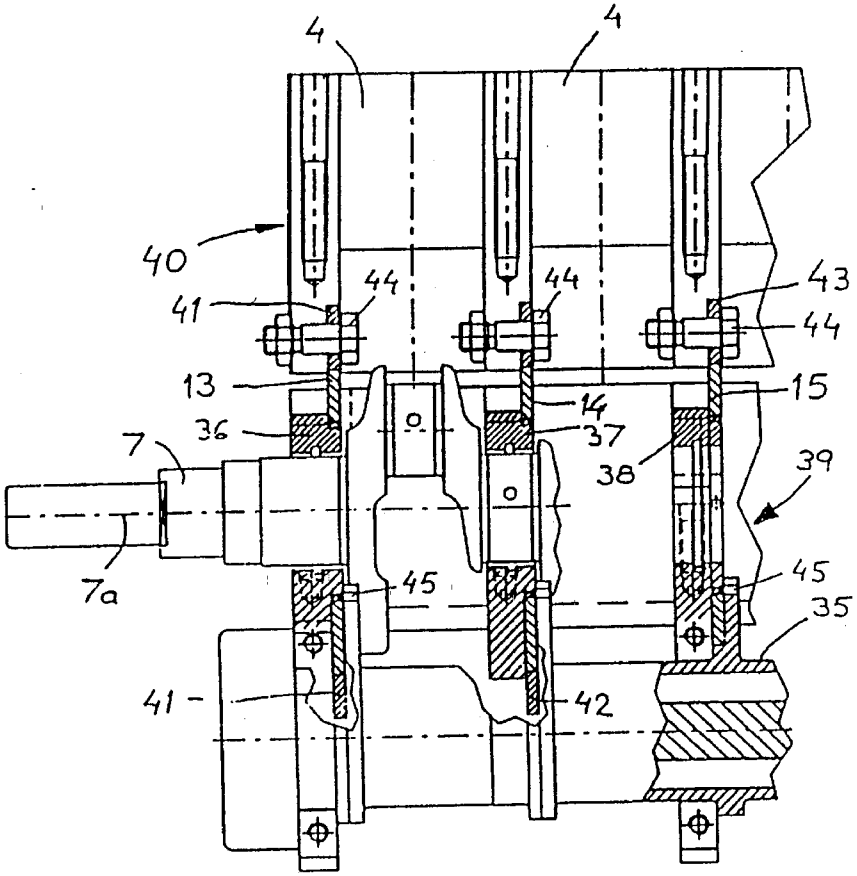
Figure 7:
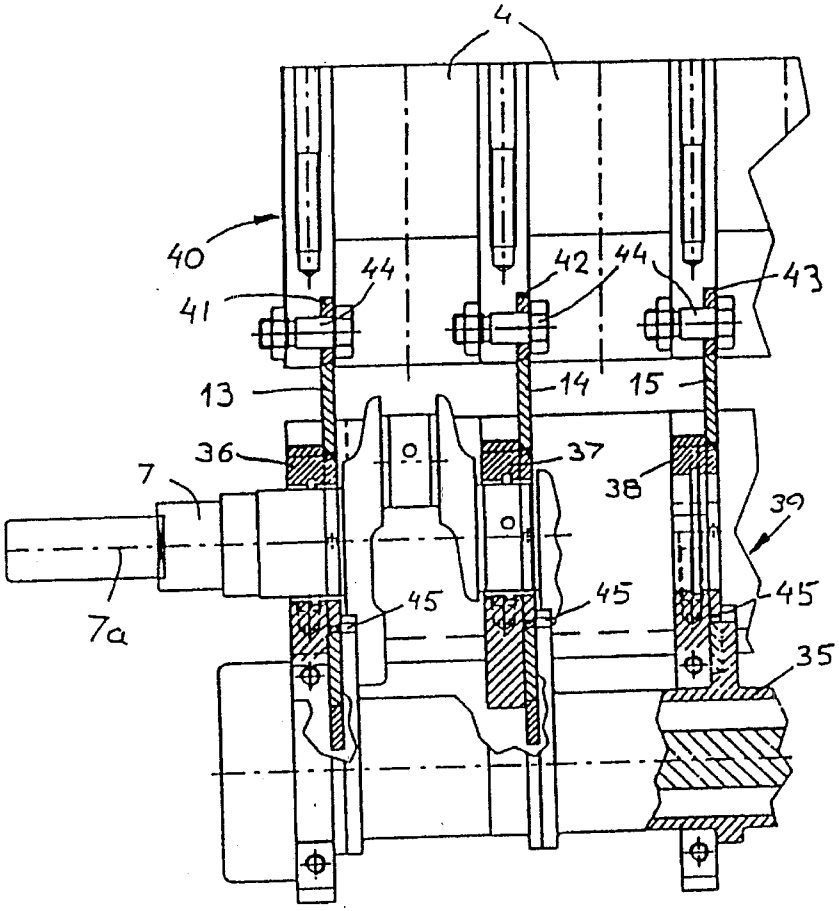

The invention will be described in more detail below with reference to the accompanying drawings, of which:

FIG. 1 is a schematic end view of an internal combustion engine with a device according to one embodiment of the invention, FIG. 1*a* is a schematic end view of a somewhat modified internal combustion engine according to FIG. 1 and shows the suspension of the engine, FIG. 2 shows a schematic section through the engine according to FIG. 1 perpendicular to the rotational axis of the crankshaft in its position for the smallest compression ratio, FIG. 3 shows a section corresponding to FIG. 2 but in its position for the highest compression ratio, FIG. 4 shows a schematic longitudinal section through the engine according to FIG. 1, essentially through the longitudinal axis of the cylinders, in the position for the smallest compression ratio, FIG. 5 shows a section corresponding to FIG. 4, but in its position for the highest compression ratio, FIG. 6 is a schematic, partially cut-away end view of an engine according to another embodiment of the invention, FIG. 7 shows a schematic longitudinal section through a portion of the engine according to FIG. 6, essentially through the longitudinal axis of the cylinders, in the position for the smallest compression ratio, FIG. 8 shows a section corresponding to FIG. 7, but in the position for the highest compression ratio, FIG. 9 is a schematic view of a drive device for a cam-shaft in an engine according to the invention.

The drawings show an internal combustion engine which is equipped with a device according to the invention. The internal combustion engine comprises in a known manner an engine block 1 and a cylinder head 2. The engine block 1 is closed at its bottom in a known manner by means of an oil pan 3 and has a number of cylinders 4, in each of which there is arranged a piston 5 for reciprocal movement. Each piston 5 is connected by means of a piston rod 6 (shown as a heavy dash-dot line in FIGS. 2–5) to a crankshaft 7, which is mounted in the engine block 1 for rotation about a rotational axis 7*a*.

The cylinder head 2 is made in a known manner with a combustion chamber 8 for each cylinder 4 and inlet and outlet ducts to permit gas exchange in the combustion chamber 8. Of these ducts, FIGS. 2 and 3 show an inlet duct 9, the communication of which with the combustion chamber 8 is controlled by means of a valve 10, which is in turn controlled by means of a valve mechanism 11. The valve mechanism 11 constitutes no part of the present invention and therefore will not be described in more detail here. The valve mechanism 11 is in turn driven by the crankshaft 7, and this drive device will be described in more detail below.

In the cylinder head 2, there is also a spark plug 12 for each cylinder 4, which, in a known manner, extends with its inner end into the combustion chamber 8. The spark plug 12 and the ignition system, of which it is a part do not constitute a part of the present invention either and therefore will not be described in more detail here. If the engine is a diesel engine, there is of course no spark plug, there being instead a jet for fuel injection.

The crankshaft 7 is, according to the invention, mounted for rotation in crankshaft bearings in the engine block 1. Each crankshaft bearing comprises, in the embodiment according to FIGS. 1–5, an adjustment disc 13, 14 or 15, as is best shown in FIGS. 4 and 5. Each of the adjustment discs 13, 14 and 15 is thus provided with a bearing opening 16, 17 and 18, respectively, and the crankshaft 7 is mounted for rotation in these bearing openings. The bearing openings 16, 17 and 18, respectively, are excentrically arranged in the adjustment discs 13, 14 and 15, respectively, as is best shown in FIGS. 2 and 3. The adjustment discs 13, 14 and 15 are in turn mounted for rotation in bearing openings 19, 20 and 21 an the engine block 1.

The adjustment discs 13 and 15 located at the ends of the engine are also made with bearing races 22 and 23, respectively, which are arranged concentrically to the rotational axis 7*a* of the crankshaft 7. On the bearing races 22 and 23, bearings 24 and 25, respectively, are arranged, said bearings being arranged in bearing openings 26 and 27, respectively, in the ends 28 and 29, respectively, of a frame 30. The frame 30 surrounds the engine block 1 and supports, via the adjustment discs 13 and 15, the entire engine. The frame 30 is intended to be permanently mounted, and a clutch and a gear box can be connected in a known manner to the end 29 of the frame 30.

When the adjustment discs 13, 14 and 15 are turned by means of a mechanism which will be described in more detail below, the engine block 1 and the cylinder head 2 will be displaced relative to the frame 30. In order for this displacement to be effected in the desired manner, the engine block 1 is guided relative to the frame 30 in the manner shown in FIG. 1*a*. The oil pan 3, or the corresponding lower portions of the engine, supports a guide pin 61 for this purpose, which is parallel to the crankshaft 7 and runs in a guide groove 62, which is arranged in the frame 30 (see also FIGS. 4 and 5). The guide groove 62 is shaped so that the engine block 1 and the cylinder head 2 are displaced in the desired path. FIG. 1*a* also shows two engine mountings 63 which are arranged on the frame 30 for suspending the same relative to the vehicle, in which the engine is mounted. Only very small portions 64 of the vehicle are shown at the engine mountings 63.

The adjustment discs 13, 14 and 15 are provided with toothed segments 31, 32 and 33, respectively, which are concentric to the bearing openings 19, 20 and 21, respectively, in the engine block 1. The toothed segments 31, 32 and 33 are in engagement with gears, of which one is shown at 34 in FIGS. 2 and 3, on a hollow adjuster shaft 35 which is mounted for rotation in the engine block 1. The adjuster shaft 35 is thus made as a part of a hydraulic rotational cylinder, and it is shown in the vicinity of its end positions in FIGS. 2 and 3.

As the adjustment discs 13, 14 and 15 are rotated by means of the gears 34 on the adjuster shaft 35, the axis of rotation 7*a* of the crankshaft 7 will be displaced relative to the engine block 1 and the cylinder head 2. In the embodiment shown in the drawings, this occurs by the engine block 1 and the cylinder head 2 being displaced relative to the crankshaft 7 while the rotational axis 7*a* of the crankshaft 7 is fixed relative to the frame 30. As the adjustment discs 13, 14 and 15 are rotated, the surface of the cylinder head 2 which delimits the combustion chamber 8 in the cylinder 4 is displaced toward or away from the axis 7*a* of the crankshaft 7. This means that the upper end position of the piston 5 is changed, which in turn changes the volume of the combustion chamber 8 when the piston 5 is at its upper end position. This means also that the compression ratio of the engine is changed. FIGS. 2 and 4 show the piston 5 in its upper end position with the rotational axis 7*a* of the crankshaft 7 located at its greatest possible distance from the cylinder head 2, and in FIGS. 3 and 5, the piston 5 is shown in its upper end position with the rotational axis 7*a* of the crankshaft 7 located at its smallest possible distance from the cylinder head 2. This means that FIGS. 2 and 4 show the lowest possible compression ratio, while FIGS. 3 and 5 show the highest possible compression ratio.

FIGS. 6–8 show an engine according to another embodiment of the invention. This differs in certain respects from the engine according to FIGS. 1–5. The components, which are common to the two embodiments, are, however, labelled in all the Figures with the same reference designations.

In the engine according to FIGS. 6–8, the crankshaft 7 is mounted for rotation in bearings 36–38 in an engine block 39, which in this case does not include the engine cylinders 4. These are instead arranged in a cylinder bank 40, which is arranged above the engine block 39 and on which the cylinder head 2 is mounted.

The cylinder bank 40 is joined to the engine block 39 by means of the adjustment discs 13–15, which are mounted for rotation about the bearings 36–38, and connection discs 41–43. The connection discs 41–43 are mounted on the outer circumference of each adjustment disc 13–15 and are joined to the cylinder bank 40 by means of screws 44.

The adjuster shaft 35 in the embodiment according to FIGS. 6–8 is made with tooth segments 45 for engagement with the tooth segments 31–33 of the adjustment discs 13–15, as is best revealed in FIG. 6.

As the adjustment discs 13–15 are turned, the cylinder bank 40 and the cylinder head 2 will be displaced relative to the engine block 39, so that one obtains the desired change in the compression ratio in a manner corresponding to that described in connection with the embodiment according to FIGS. 1–5. In FIG. 7, the crankshaft 7 is shown with its rotational axis 7*a* located at the greatest possible distance from the cylinder head 2, while FIG. 8 shows the rotational axis 7*a* of the crankshaft 7 located at the smallest possible distance from the cylinder head 2. This means that FIG. 7 shows the smallest possible compression ratio, while FIG. 8 shows the highest possible compression ratio.

The embodiment shown in FIGS. 6–8 is also possible to use with engines with several banks of cylinders, for example V-engines and boxer engines, where all the cylinder banks can be manoeuvred by means of a single adjuster shaft.

FIGS. 1 and 6 also show a device for driving an intermediate shaft 46 arranged in the cylinder head 2, said intermediate shaft driving in turn the valve mechanism 11. The intermediate shaft 46 is driven by the crankshaft 7 by means of a drive chain 47 which is shown with dash-dot lines. The drive chain 47 is driven by the crankshaft 7, and when the cylinder head 2 is displaced relative to the crankshaft 7, by the adjustment discs 13, 14 and 15 being turned, the distance between the intermediate shaft 46 and the crankshaft 7 will of course be changed. In order to keep the drive shaft 47 always taut, it is led on either side of the crankshaft 7 over equalizer wheels 48. Each equalizer wheel 48 is mounted on an arm 49, one end of which is pivoted about a point 50 which is fixed relative to the crankshaft 7. The other end of each arm 47 is pivotally connected to a point 51 which is moveable together with the cylinder head 2. In this manner, regardless of the position of the rotational axis 7*a* of the crankshaft 7 relative to the cylinder head 2, the drive chain 47 will be held taut, and this is done without any change in the relative rotational position between the crankshaft 7 and the intermediate shaft 46.

As can be seen in FIGS. 1 and 6, the intermediate shaft 46 drives a secondary chain 52 or 53, respectively, which in turn drives the valve mechanism 11. The secondary chain 52 or 53, respectively, is not affected by the movement of the cylinder head 2 relative to the crankshaft 7, and therefore no equalizer devices for the secondary chain 52 or 53, respectively, are required.

FIG. 9 shows an alternative embodiment of the driving device for the valve mechanism 11. In this embodiment, the crankshaft 7 drives a drive shaft 54 in the valve mechanism by means of a single drive means in the form of a toothed belt 55 with teeth on both sides. The toothed belt 55 is led over equalizer wheels 56 on both sides of the crankshaft 7. The equalizer wheels 56 are, in a manner corresponding to the embodiment shown in FIGS. 1 and 6, mounted on arms 57. One end of each arm is pivoted to a point 58 which is fixed relative to the crankshaft 7, while the other end of each arm 57 is pivotally joined to a point 59 which is fixed relative to the cylinder housing 2. There is also a tensioning wheel 60 which is arranged to keep the toothed belt 55 under suitable tension to avoid slack. FIG. 7 shows one end position for the arms 57 with solid lines, while the other end position is shown with dash-dot lines. It should also be noted in this context that the toothed belt 55 can be replaced by a chain if this should be desirable.

As is particularly evident from FIGS. 2 and 3, rotating the adjustment discs 13–15 displaces the cylinder head 2 not only parallel to the longitudinal axis of the cylinder 4, but also perpendicular thereto. The displacement is thus effected in two dimensions. This changes of course also the angle of the piston rod 6 relative to the longitudinal axis of the cylinder 4.

This change in the angle of the piston rod 6 relative to the longitudinal axis 4*a* of the cylinder 4 is revealed by a comparison of FIGS. 2 and 3, which both show the position when the piston 5 is in its upper end position. In FIG. 2, the cylinder head 2 is displaced laterally relative to the longitudinal axis of the cylinder 4. This means that the piston 5 during the last portion of the compression stroke will move a longer distance for each degree of a turning of the crankshaft 7 than in the first portion of the subsequent power stroke. In this manner, it is possible to increase the efficiency of the engine.

In FIG. 3, the cylinder head 2 is displaced a smaller distance relative to the longitudinal axis of the cylinder 4, and it is of course possible by suitable dimensioning of the adjustment discs 13–15 and suitable placement thereof to achieve a lateral displacement of the cylinder head 2 which provides the desired pattern of movement of the piston 5 at various compression ratios.

That described above also applies, of course, to the embodiments shown in FIGS. 6–8.

The device described above, as was mentioned previously, makes it possible to change the compression ratio of the engine within a wide range. This change can be done when the engine is operating, and by suitable control of the movements of the adjuster shaft 35, it is possible to change the compression ratio of the engine in such a manner that it is adapted to the current load conditions. This change is effected by means of a single operating means in the form of an adjuster shaft, and this applies regardless of the number of cylinders in the engine and regardless of the number of cylinder banks and their placement.

I claim:

1. In a process for setting the compression ratio of an internal combustion engine by changing the relative distance between the axis of rotation of the engine crankshaft and the engine cylinder head surface delimiting the end of each cylinder in the engine, the relative displacement between the rotational axis of the crankshaft and the cylinder head being effected along a predetermined path that has components both parallel to a plane containing the longitudinal axis of each of the engine cylinders and perpendicular to said plane;

the improvement comprising holding the crankshaft with its rotational axis stationary in relation to the engine mountings and the vehicle in which the engine is mounted, and displacing the cylinder head along the predetermined path together with the cylinder.

2. A process according to claim 1, wherein the predetermined path is a circular arcuate path.

3. A process according to claim 1, wherein the predetermined path is an essentially straight path, which is disposed at an acute angle to the longitudinal axis of each cylinder.

4. In a device for setting the compression ratio in an internal combustion engine by changing the relative distance between the rotational axis (7*a*) of the engine crankshaft (7) and the engine cylinder head (2) surface delimiting the end of each cylinder (4) in the engine, the crankshaft (7) being mounted for rotation in eccentrically placed bearing openings (16–18) in circular adjustment discs (13–15), which are rotatably mounted in bearing openings (19–21) in the engine block (1), a rotating device (31–35) being coupled to the adjustment discs (13–15) for simultaneous rotation thereof relative to the engine block (1); the improvement wherein a said adjustment disc (13, 15) is mounted at each end of the crankshaft (7), each of said adjustment discs (13, 15) having a bearing race (22, 23) concentric to the bearing opening (16–18), by means of which race the adjustment disc (13, 15) is rotatably mounted in a frame (30), and wherein the engine block (1), by means of at least one guide means, is joined to the frame (30) for controlled displacement relative thereto upon rotation of the adjustment discs (13–15) by means of the rotating device (31–35), which is fixed relative to the engine block (1).

5. In a device for setting the compression ratio in an internal combustion engine by changing the relative distance between the rotational axis of the engine crankshaft and the engine cylinder head surface delimiting the end of each engine cylinder;

the improvement wherein the crankshaft (7) is mounted for rotation in bearings (36–38) in the engine block (39), circular adjustment discs (13–15) mounted in eccentrically placed bearing openings for rotation in the engine block (39), at least one cylinder bank (40) housing the engine cylinders (4) and on which the cylinder head (2) is mounted, said cylinder bank being joined to connection discs (41–43) which are mounted on the outer circumference of the adjustment discs (13–15), and a rotating device (31, 35, 45) coupled to the adjustment discs (13–15) for simultaneous rotation thereof to move the cylinder head (2) relative to the engine block (39).

6. Device according to claim 4, wherein the rotating device consists of a hydraulic rotational cylinder (35) with gears or toothed segments (34, 45) in engagement with toothed segments (31–33) on each of the adjustment discs (13–15).

7. Device according to claim 5, wherein the rotating device consists of a hydraulic rotational cylinder (35) with gears or toothed segments (34, 45) in engagement with toothed segments (31–33) on each of the adjustment discs (13–15).

8. Device according to claim 4, wherein the crankshaft (7) drives a valve mechanism (11) in the cylinder head (2) by means of at least one drive means in the form of a chain (47) or a toothed belt (55), and wherein the drive means (47, 55) is led over two equalizer wheels (48, 56), which are arranged for displacement corresponding to the displacement of the cylinder head relative to the rotational axis (7*a*) of the crankshaft (7) without any mutual rotational movement between the crankshaft (7) and the valve mechanism (11).

9. Device according to claim 5, wherein the crankshaft (7) drives a valve mechanism (11) in the cylinder head (2) by means of at least one drive means in the form of a chain (47) or a toothed belt (55), and wherein the drive means (47, 55) is led over two equalizer wheels (48, 56), which are arranged for displacement corresponding to the displacement of the cylinder head relative to the rotational axis (7*a*) of the crankshaft (7) without any mutual rotational movement between the crankshaft (7) and the valve mechanism (11).

* * * * *